US009689321B2

(12) United States Patent
Kang et al.

(10) Patent No.: US 9,689,321 B2
(45) Date of Patent: Jun. 27, 2017

(54) ENGINE TORQUE CONTROL WITH COMBUSTION PHASING

(71) Applicant: GM GLOBAL TECHNOLOGY OPERATIONS LLC, Detroit, MI (US)

(72) Inventors: Jun-Mo Kang, Ann Arbor, MI (US); Orgun A. Guralp, Ann Arbor, MI (US); Sai S. V. Rajagopalan, Bloomfield Hills, MI (US); Hanho Yun, Oakland Township, MI (US); Chen-Fang Chang, Bloomfield Hills, MI (US); Paul M. Najt, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 181 days.

(21) Appl. No.: 14/735,653

(22) Filed: Jun. 10, 2015

(65) Prior Publication Data

US 2016/0363059 A1 Dec. 15, 2016

(51) Int. Cl.

| | |
|---|---|
| ***F02D 29/02*** | (2006.01) |
| ***F02D 35/02*** | (2006.01) |
| ***F02P 5/153*** | (2006.01) |
| *F02P 5/15* | (2006.01) |
| *F02P 5/00* | (2006.01) |

(52) U.S. Cl.

CPC ..... *F02D 35/028* (2013.01); *F02D 29/02* (2013.01); *F02D 35/023* (2013.01); *F02P 5/153* (2013.01); *F02D 35/024* (2013.01); *F02P 5/00* (2013.01); *F02P 5/1512* (2013.01)

(58) Field of Classification Search

CPC ..... F02D 35/028; F02P 5/00; F02P 5/1512; F02P 5/153

USPC ..... 123/406.19, 406.2, 406.22, 406.23, 123/406.24, 406.25, 406, 41, 406.43, 123/406.5, 406.51, 406.52, 435

See application file for complete search history.

(56) References Cited

U.S. PATENT DOCUMENTS

| | | | | |
|---|---|---|---|---|
| 5,577,474 | A | 11/1996 | Livshiz et al. | |
| 5,740,045 | A | 4/1998 | Livshiz et al. | |
| 7,117,082 | B2 * | 10/2006 | Kohira | F02D 35/023 701/114 |
| 7,206,688 | B2 | 4/2007 | Wang et al. | |
| 7,321,821 | B2 | 1/2008 | Kolmanovsky et al. | |

(Continued)

*Primary Examiner* — Sizo Vilakazi
*Assistant Examiner* — Kevin R Steckbauer
(74) *Attorney, Agent, or Firm* — Quinn IP Law

(57) ABSTRACT

An engine assembly includes an internal combustion engine with an engine block having at least one cylinder and at least one piston moveable within the at least one cylinder. A crankshaft is moveable to define a plurality of crank angles (CA) from a bore axis defined by the cylinder to a crank axis defined by the crankshaft. A controller is operatively connected to the internal combustion engine and configured to receive a torque request ($T_R$). The controller is programmed to determine a desired combustion phasing ($CA_d$) for controlling a torque output of the internal combustion engine. The desired combustion phasing is based at least partially on the torque request ($T_R$) and a pressure-volume (PV) diagram of the at least one cylinder.

16 Claims, 4 Drawing Sheets

(56) References Cited

U.S. PATENT DOCUMENTS 7,509,932 B2 * 3/2009 Hara ..... F02D 35/023 123/90.15
7,614,384 B2 11/2009 Livshiz et al.
7,651,440 B2 1/2010 Runde
8,019,568 B2 9/2011 Lehner et al.
8,469,002 B2 * 6/2013 Kang ..... F02D 13/0207 123/406.23
8,627,804 B2 * 1/2014 Kang ..... F02D 41/0062 123/406.44
8,826,884 B2 * 9/2014 Kang ..... F02D 35/023 123/305
8,955,492 B2 * 2/2015 Wermuth ..... F02B 17/005 123/305
9,008,944 B2 * 4/2015 Wermuth ..... F02D 35/02 701/102
9,376,979 B2 * 6/2016 Jade ..... F02D 41/2451
2005/0274358 A1 * 12/2005 Kohira ..... F02D 35/023 701/114
2010/0057330 A1 3/2010 Whitney et al.
2011/0283972 A1 * 11/2011 Wermuth ..... F02B 17/005 123/406.12
2011/0288742 A1 * 11/2011 Wermuth ..... F02D 35/02 701/102
2012/0103304 A1 * 5/2012 Kang ..... F02D 35/023 123/305
2012/0118267 A1 * 5/2012 Kang ..... F02D 13/0207 123/406.26
2012/0118275 A1 * 5/2012 Kang ..... F02D 41/0062 123/568.11
2012/0303240 A1 * 11/2012 Taibi ..... F02D 35/023 701/102
2016/0123247 A1 * 5/2016 Mizoguchi ..... B60W 10/06 123/406.55
2016/0305351 A1 * 10/2016 Barta ..... F02D 41/14
2016/0377043 A1 * 12/2016 Wang ..... G05B 15/02 701/111

* cited by examiner

ENGINE TORQUE CONTROL WITH COMBUSTION PHASING

TECHNICAL FIELD

The disclosure relates generally to control of torque in an internal combustion engine, and more specifically, to control of torque in an engine assembly with combustion phasing.

BACKGROUND

Many modern engines are equipped with multiple actuators to achieve better fuel economy. With multiple actuators, however, it becomes more challenging to accurately control the torque due to increasing complexity of the system. The torque control methods for such engines typically require numerous calibrations.

SUMMARY

An engine assembly includes an internal combustion engine with an engine block having at least one cylinder and at least one piston moveable within the at least one cylinder. A crankshaft is moveable to define a plurality of crank angles (CA) from a bore axis defined by the cylinder to a crank axis defined by the crankshaft. At least one intake valve and at least one exhaust valve are each in fluid communication with the at least one cylinder and have respective open and closed positions. A controller is operatively connected to the internal combustion engine and configured to receive a torque request ($T_R$). The controller is programmed to determine a desired combustion phasing ($CA_d$) for controlling a torque output of the internal combustion engine. The desired combustion phasing is based at least partially on the torque request ($T_R$) and a pressure-volume (PV) diagram of the at least one cylinder.

The desired combustion phasing ($CA_d$) may be characterized by a crank angle (CA) corresponding to 50% of fuel being combusted, with the piston being after a top-dead-center (TDC) position. Determining the desired combustion phasing ($CA_d$) includes: obtaining a first parameter ($Z_1$) for each of the plurality of crank angles (CA) based at least partially on a respective cylinder volume ($V_{CA}$) of the at least one cylinder, a predefined first constant ($\gamma$), a predefined second constant ($k_1$) and a predefined third constant ($k_2$), such that $Z_1=[(k_1*CA+k_2)*(V_{CA})^{\gamma-1}]$. The first parameter ($Z_1$) is approximated with a quadratic function of the plurality of crank angles (CA) having first, second and third coefficients (a, b, c) such that $Z_1=[a*CA^2+b*CA+c]$.

Determining the desired combustion phasing ($CA_d$) includes obtaining the first, second and third coefficients (a, b, c). A second parameter ($Z_2$) is obtained as a sum of respective geometrical areas of a plurality of geometrical shapes in the log-scaled pressure-volume (PV) diagram of the at least one cylinder, such that $Z_2=(A_R+A_{T1}+A_{T2})$. Here $A_R$ is an area of a rectangle in the log-scaled pressure-volume (PV) diagram. Here $A_{T1}$ and $A_{T2}$ are respective areas of a first and a second triangle in the log-scaled pressure-volume (PV) diagram.

Determining the desired combustion phasing ($CA_d$) includes: obtaining a third parameter ($Z_3$) as a sum of the second parameter ($Z_2$) and a product of the torque request ($T_R$) and pi ($\pi$) such that $[Z_3=Z_2+(T_R*\pi)]$. The desired combustion phasing ($CA_d$) may be obtained based at least partially on the third parameter ($Z_3$), a fuel mass ($m_f$), the first, second and third coefficients (a, b, c), a volume ($V_{EVO}$) of the at least one cylinder when the exhaust valve is opening, the predefined first constant ($\gamma$), the predefined second constant ($k_1$), the predefined third constant ($k_2$) and a predefined fourth constant ($Q_{LHV}$).

The controller may be programmed to determine an optimal combustion phasing ($CA_m$) for maximizing a net-mean-effective-pressure of the at least one cylinder, the optimal combustion phasing ($CA_m$) being based at least partially on the first and second coefficients (a, b), the volume ($V_{EVO}$) of the at least one cylinder when the exhaust valve is opening, the predefined first constant ($\gamma$) and the predefined second constant ($k_1$). The controller may be programmed to determine a desired spark timing ($SP_d$) for controlling the torque output of the internal combustion engine based at least partially on the desired combustion phasing ($CA_d$), the optimal combustion phasing ($CA_m$), a predefined nominal spark timing ($SP_{nom}$) to achieve the optimal combustion phasing ($CA_m$) and a predefined conversion factor (h).

The desired combustion phasing ($CA_d$) may be employed in an engine having a spark-ignition mode. In spark-ignition engines, the mass of fuel to inject in the cylinder is tied to airflow since the after-treatment system requires, for example, a stoichiometric air-to-fuel ratio to meet stringent emissions regulations. When torque demand changes faster than airflow, the desired combustion phasing ($CA_d$) may be used to meet the torque demand.

The above features and advantages and other features and advantages of the present disclosure are readily apparent from the following detailed description of the best modes for carrying out the disclosure when taken in connection with the accompanying drawings.

DETAILED DESCRIPTION

Figure 1:
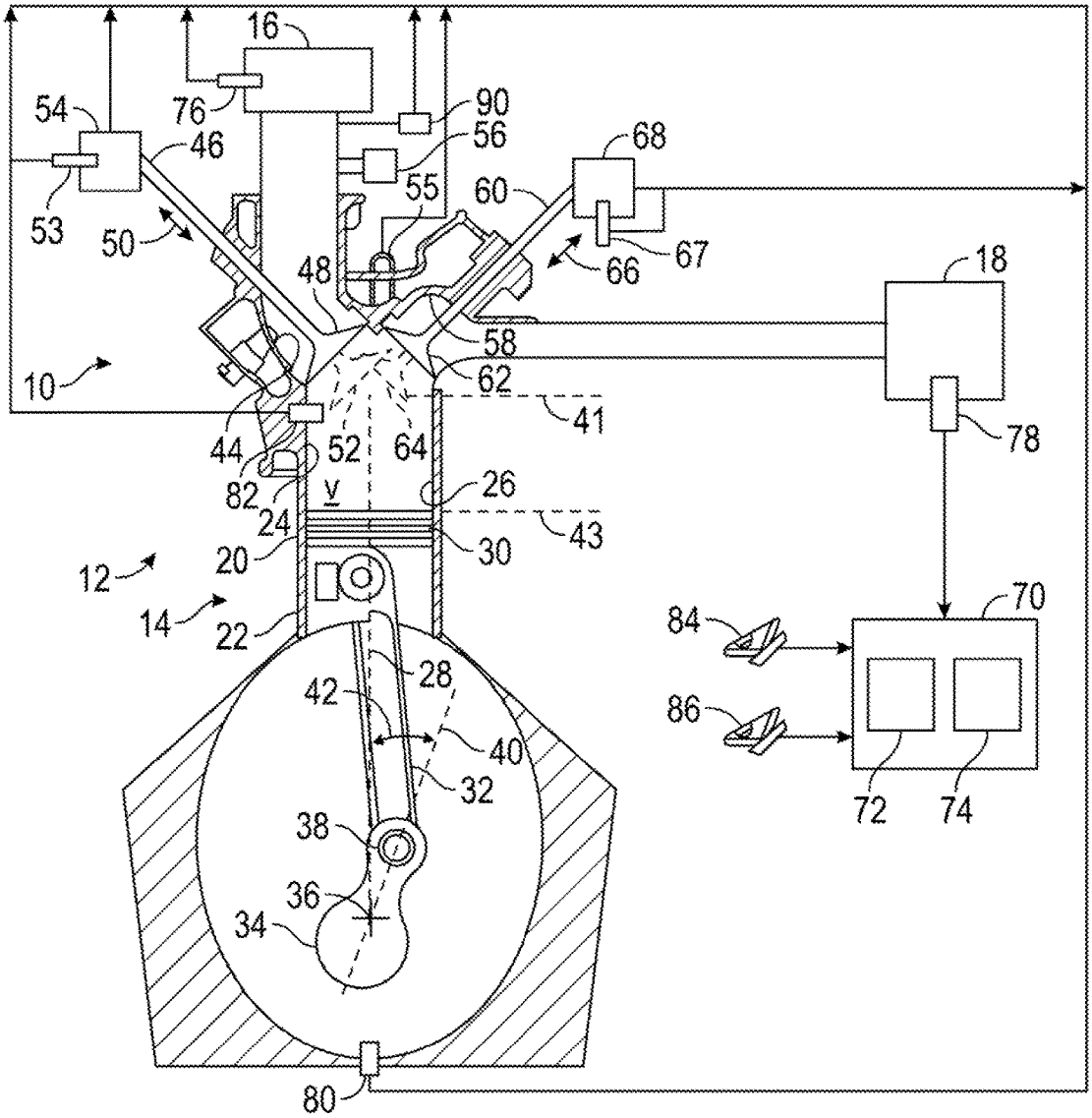
FIG. 1 is a schematic fragmentary view of a vehicle including an engine assembly with at least one cylinder having at least one piston, at least one intake valve and at least one exhaust valve.

Referring to the drawings, wherein like reference numbers refer to like components, FIG. 1 schematically illustrates a vehicle 10 having an engine assembly 12. The engine assembly 12 includes an internal combustion engine 14, referred to herein as engine 14, for combusting an air-fuel mixture in order to generate output torque. The engine assembly 12 includes an intake manifold 16 in fluid communication with the engine 14. The intake manifold 16 may be configured to receive fresh air from the atmosphere. The intake manifold 16 is fluidly coupled to the engine 14, and capable of directing air into the engine 14. The engine assembly 12 includes an exhaust manifold 18 in fluid communication with the engine 14, and capable of receiving exhaust gases from the engine 14.

Referring to FIG. 1, the engine 14 includes an engine block 20 having at least one cylinder 22. The cylinder 22 has an inner cylinder surface 24 defining a cylinder bore 26. The cylinder bore 26 extends along a bore axis 28. The bore axis 28 extends along a center of the cylinder bore 26. A piston 30 is positioned inside the cylinder 22. The piston 30 is configured to move or reciprocate inside the cylinder 22 along the bore axis 28 during the engine cycle.

The engine 14 includes a rod 32 pivotally connected to the piston 30. Due to the pivotal connection between rod 32 and the piston 30, the orientation of the rod 32 relative to the bore axis 28 changes as the piston 30 moves along the bore axis 28. The rod 32 is pivotally coupled to a crankshaft 34. Accordingly, the movement of the rod 32 (which is caused by the movement of the piston 30) causes the crankshaft 34 to rotate about its center 36. A fastener 38, such as a pin, movably couples the rod 32 to the crankshaft 34. The crankshaft 34 defines a crank axis 40 extending between the center 36 of the crankshaft 34 and the fastener 38.

Referring to FIG. 1, a crank angle 42 is defined from the bore axis 28 to the crank axis 40. As the piston 30 reciprocates along the bore axis 28, the crank angle 42 changes due to the rotation of the crankshaft 34 about its center 36. Accordingly, the position of the piston 30 in the cylinder 22 can be expressed in terms of the crank angle 42. The piston 30 can move within the cylinder 22 between a top dead center (TDC) position (i.e., when the top of the piston 30 is at the line 41) and a bottom dead center (BDC) position (i.e., when the top of the piston 30 is at the line 43). The TDC position refers to the position where the piston 30 is farthest from the crankshaft 34, whereas the BDC position refers to the position where the piston 30 is closest to the crankshaft 34. When the piston 30 is in the TDC position (see line 41), the crank angle 42 may be zero (0) degrees. When the piston 30 is in the BDC position (see line 43), the crank angle 42 may be one hundred eighty (180) degrees.

Referring to FIG. 1, the engine 14 includes at least one intake port 44 in fluid communication with both the intake manifold 16 and the cylinder 22. The intake port 44 allows gases, such as air, to flow from the intake manifold 16 into the cylinder bore 26. The engine 14 includes at least one intake valve 46 capable of controlling the flow of gases between the intake manifold 16 and the cylinder 22. Each intake valve 46 is partially disposed in the intake port 44 and can move relative to the intake port 44 between a closed position 48 and an open position 52 (shown in phantom) along the direction indicated by double arrows 50. When the intake valve 46 is in the open position 52, gas, such as air, can flow from the intake manifold 16 to the cylinder 22 through the intake port 44. When the intake valve 46 is in the closed position 48, gases, such as air, are precluded from flowing between the intake manifold 16 and the cylinder 22 through the intake port 44. A first cam phaser 54 may control the movement of the intake valve 46.

Referring to FIG. 1, the engine 14 may receive fuel from a fuel source 56. The fuel may be injected with any type of injector known to those skilled in the art and through any location in the engine 14, e.g., port fuel injection and direct injection. As noted above, the engine 14 can combust an air-fuel mixture, producing exhaust gases. Referring to FIG. 1, the at least one cylinder 22 is operatively connected to a spark plug 55. The spark-plug 55 is capable of producing an electric spark in order to ignite the compressed air-fuel mixture in the cylinder 22. It is to be understood that the engine 14 may include multiple cylinders with corresponding spark plugs. The engine 14 further includes at least one exhaust port 58 in fluid communication with the exhaust manifold 18. The exhaust port 58 is also in fluid communication with the cylinder 22 and fluidly interconnects the exhaust manifold 18 and the cylinder 22. Thus, exhaust gases can flow from the cylinder 22 to the exhaust manifold 18 through the exhaust port 58.

The engine 14 further includes at least one exhaust valve 60 capable of controlling the flow of exhaust gases between the cylinder 22 and the exhaust manifold 18. Each exhaust valve 60 is partially disposed in the exhaust port 58 and can move relative to the exhaust port 58 between closed position 62 and an open position 64 (shown in phantom) along the direction indicated by double arrows 66. When the exhaust valve 60 is in the open position 64, exhaust gases can flow from the cylinder 22 to the exhaust manifold 18 through the exhaust port 58. When the exhaust valve 60 is in the closed position 62, exhaust gases are precluded from flowing between the cylinder 22 and the exhaust manifold 18 through the exhaust port 58. A second cam phaser 68 may control the movement of the exhaust valve 60. Furthermore, the second cam phaser 68 may operate independently of the first cam phaser 54.

Referring to FIG. 1, the engine assembly 12 includes a controller 70 operatively connected to or in electronic communication with the engine 14. Referring to FIG. 1, the controller 70 includes at least one processor 72 and at least one memory 74 (or any non-transitory, tangible computer readable storage medium) on which are recorded instructions for executing method 100, shown in FIG. 2A, and described below. The memory 74 can store controller-executable instruction sets, and the processor 72 can execute the controller-executable instruction sets stored in the memory 74.

The controller 70 of FIG. 1 is specifically programmed to execute the steps of the method 100 and can receive inputs from various sensors. For example, the engine assembly 12 may include a first pressure sensor 76 in communication (e.g., electronic communication) with the intake manifold 16 and the controller 70, as shown in FIG. 1. The first pressure sensor 76 is capable of measuring the pressure of the gases (e.g., air) in the intake manifold 16 (i.e., the intake manifold pressure) and sending input signals to the controller 70. The controller 70 may determine the intake manifold pressure based on the input signals from the first pressure sensor 76. The engine assembly 12 may include an air flow sensor 90 in electronic communication with the intake manifold 16 and the controller 70.

The engine assembly 12 may include a second pressure sensor 78 in communication (e.g., electronic communication) with the controller 70 and the exhaust manifold 18, as shown in FIG. 1. The second pressure sensor 78 is capable of determining the pressure of the gases in the exhaust manifold (i.e., the exhaust manifold pressure) and sending input signals to the controller 70. The controller 70 may determine the exhaust manifold pressure based on the input signals from the second pressure sensor 78. Additionally, controller 70 may be programmed to determine the exhaust manifold pressure based on other methods or sensors, without the second pressure sensor 78. The exhaust manifold pressure may be estimated by any method or mechanism known to those skilled in the art. The controller 70 is in communication with the first and second cam phasers 54, 68 and can therefore control the operation of the intake and exhaust valves 46, 60. The controller 70 is also in communication with first and second position sensors 53, 67 that are configured to monitor positions of the first and second cam phasers 54, 68, respectively.

Referring to FIG. 1, a crank sensor 80 is operative to monitor crankshaft rotational position, i.e., crank angle and speed. A third pressure sensor 82 may be employed to obtain the in-cylinder combustion pressure of the at least one cylinder 22. The third pressure sensor 82 may be monitored by the controller 70 to determine a net-effective-pressure (NMEP) for each cylinder 22 for each combustion cycle.

Figure 2A:
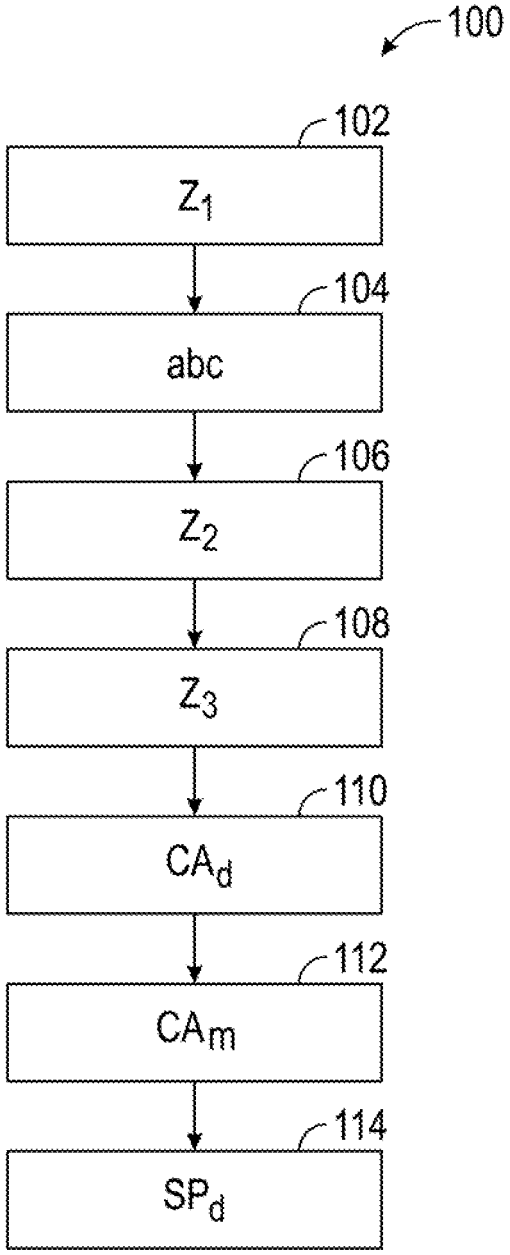
FIG. 2A is a flowchart for a method for controlling torque of the engine of FIG. 1, including obtaining a first parameter ($Z_1$)

The method 100 of FIG. 2A may be employed in an engine 14 having spark-ignition mode. In spark-ignition engines, the mass of fuel to inject in the cylinder 22 is tied to airflow since the after-treatment system requires, for example, a stoichiometric air-to-fuel ratio to meet stringent emissions regulations. When torque demand changes faster than airflow, the desired combustion phasing ($CA_d$) may be used to meet the torque demand.

Referring now to FIG. 2A, a flowchart of the method 100 stored on and executable by the controller 70 of FIG. 1 is shown. Method 100 is employed for controlling torque in the engine assembly 12 based on a desired combustion phasing ($CA_d$). Method 100 need not be applied in the specific order recited herein. Furthermore, it is to be understood that some steps may be eliminated.

The controller 70 is programmed to determine a desired combustion phasing ($CA_d$) for controlling a torque output of the engine 14. The desired combustion phasing ($CA_d$) is based at least partially on a torque request ($T_R$) and a pressure-volume (PV) diagram (such as example graph 200 in FIG. 3) of the at least one cylinder 22. The torque request ($T_R$) may be in response to an operator input or an auto start condition monitored by the controller 70. The controller 70 is configured to receive input signals from an operator, such as through an accelerator pedal 84 and brake pedal 86, to determine the torque request ($T_R$). The desired combustion phasing ($CA_d$) may be characterized by a crank angle (CA) corresponding to 50% of fuel being combusted, with the piston 30 being after a TDC (top-dead-center) position (see line 41). The method 100 assumes instantaneous combustion in a physics-based constant-volume model such that cylinder pressure instantaneously equilibrates with external pressure (such as intake or exhaust manifold pressure) once the intake valve 46 or exhaust valve 60 opens. The data from the sensors described above, including the third pressure sensor 82, may be used to calibrate the model.

Referring to FIG. 2A, method 100 may begin with block 102, where the controller 70 is programmed or configured to obtain a first parameter ($Z_1$) for each of the plurality of crank angles (CA) based at least partially on a respective cylinder volume ($V_{CA}$) of the at least one cylinder, a predefined first constant ($\gamma$), a predefined second constant ($k_1$) and a predefined third constant ($k_2$), such that:

$$Z_1=[(k_1*\mathrm{CA}+k_2)*(V_{CA})^{\gamma-1}]. \quad (1)$$

Figure 2B:
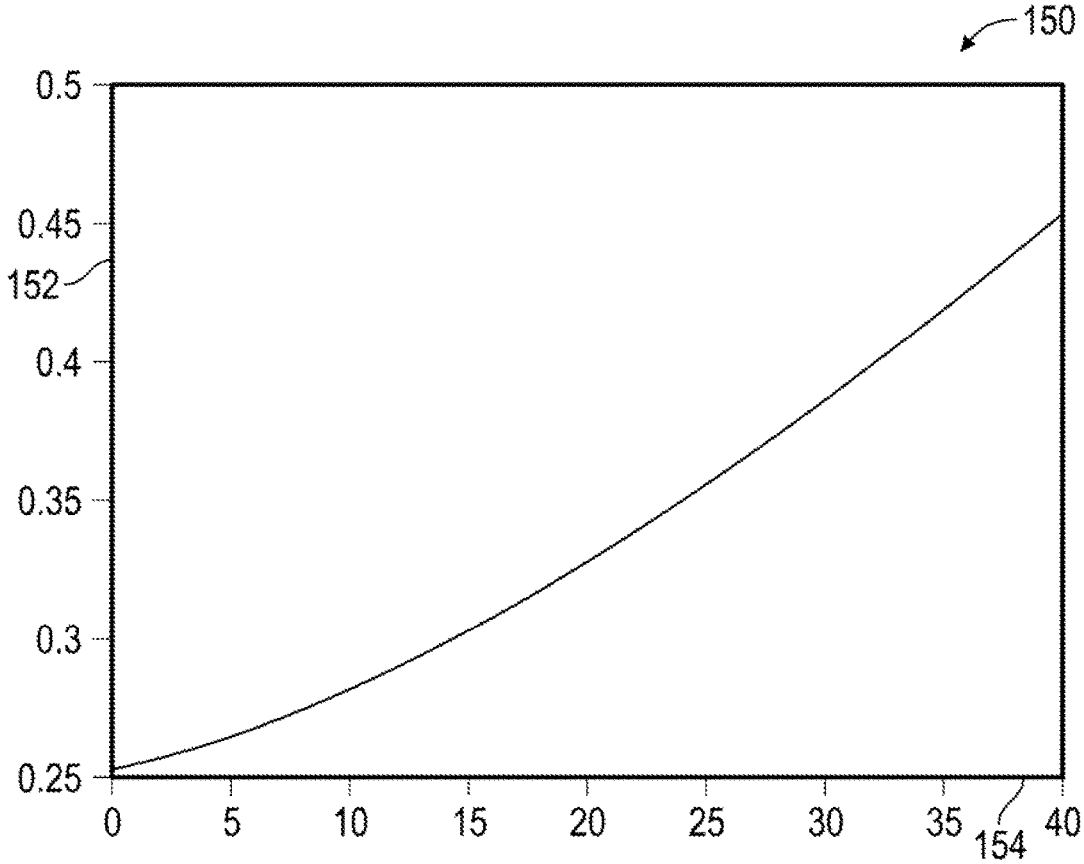
FIG. 2B is an example of a graph of the first parameter ($Z_1$) of FIG. 2A.

In other words, various values of the first parameter ($Z_1$) are obtained at various crank angles (CA). FIG. 2B shows a graph 150 of the first parameter ($Z_1$) (indicated by axis 152) versus crank angle (CA) (indicated by axis 154). The respective cylinder volumes ($V_{CA}$) at each crank angle (CA) may be determined by using known slider crank equations, the position of the crankshaft 34 (via crank sensor 80 of FIG. 1) and respective positions of the first and second camshafts 54, 68 (via first and second position sensors 53, 67, respectively). The controller 70 may store the predefined first, second and third constants ($\gamma$, $k_1$, $k_2$) in the memory 74. The predefined first constant ($\gamma$) is a polytropic coefficient. In a non-limiting example, the predefined first constant ($\gamma$) is about 1.4. The predefined second constant ($k_1$) and the predefined third constant ($k_2$) may be obtained by calibration. For example, predefined second constant ($k_1$) and the predefined third constant ($k_2$) may be obtained by modeling the combustion efficiency ($\eta$) ($\eta=k_1*\mathrm{CA}+k_2$) at various engine speeds (rpm).

In block 104 of FIG. 2A, the controller 70 is programmed to obtain the first, second and third coefficients (a, b, c) in equation (2) below. The first parameter ($Z_1$) may be approximated as a quadratic function of the plurality of crank angles (CA) with the first, second and third coefficients (a, b, c) such that:

$$Z_1=[a*\mathrm{CA}^2+b*\mathrm{CA}+c]. \quad (2)$$

The first, second and third coefficients (a, b, c) may be obtained analytically or graphically from FIG. 2B or by any other method known to those skilled in the art.

In block 106 of FIG. 2A, the controller 70 is programmed to obtain a second parameter ($Z_2$), as a sum of respective geometrical areas of a plurality of geometrical shapes in the log-scaled pressure-volume (PV) diagram as:

$$Z_2=(A_R+A_{T1}+A_{T2}). \quad (3)$$

Figure 3:
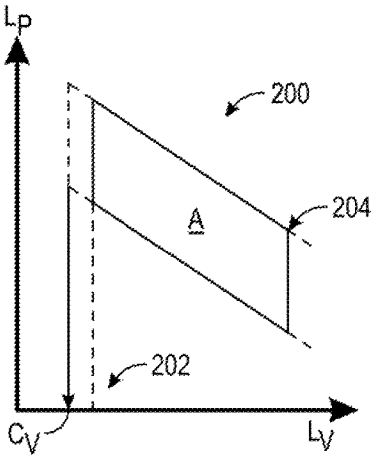
FIG. 3 is an example log-scaled pressure-volume (PV) diagram of the cylinder of FIG. 1.
Figure 4:
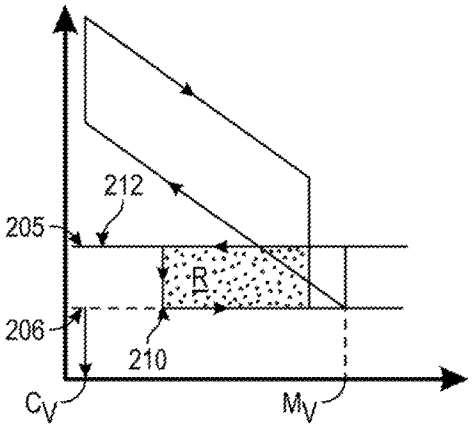
FIG. 4 is an example log-scaled pressure-volume (PV) diagram of the cylinder of FIG. 1 when there is positive valve overlap (when intake valve opens earlier than exhaust valve closes)

Here $A_R$ is an area of a rectangle (R) in the log-scaled pressure-volume (PV) diagram (lightly-shaded and labeled as "R" in FIG. 4). Additionally, $A_{T1}$ and $A_{T2}$ are respective areas of a first and a second triangle (T1, T2) in the log-scaled pressure-volume (PV) diagram (labeled as "T1" in FIGS. 5-6 and "T2" in FIGS. 7-8). As will be discussed below, FIGS. 3-8 are example log-scaled pressure-volume (PV) diagrams at various positions of the intake valve 46 and exhaust valve 60.

In block 108 of FIG. 2A, the controller 70 is programmed to obtain a third parameter ($Z_3$), as a sum of the second parameter ($Z_2$) and a product of the torque request ($T_R$) and pi ($\pi$) such that:

$$[Z_3=Z_2+(T_R*\pi)]. \quad (4)$$

In block 110 of FIG. 2A, the controller 70 is programmed to obtain the desired combustion phasing ($CA_d$) based at least partially on the third parameter ($Z_3$), a fuel mass ($m_f$), the first, second and third coefficients (a, b, c), the volume ($V_{EVO}$) of the cylinder 22 when the exhaust valve 60 is opening (moving towards open position 64), the predefined first constant ($\gamma$), the predefined second constant ($k_1$), the predefined third constant ($k_2$) and a predefined fourth constant ($Q_{LHV}$). The desired combustion phasing ($CA_d$) may be obtained by solving the following quadratic equation:

$$aV_{EVO}^{1-\gamma}CA_d^2-(k_1-bV_{EVO}^{1-\gamma})CA_{des}-k_2+cV_{EVO}^{1-\gamma}=-\frac{Z3}{Q_{LHV}m_f} \quad (5)$$

The fuel mass ($m_f$) in equation (5) may be determined as air mass divided by the stoichiometric air-to-fuel-ratio (AFR) [$m_f$=air mass/stoichiometric AFR]. Referring to FIG. 1, the air mass may be obtained through the air flow sensor 90 operatively connected to the intake manifold 16 or any other suitable method. During operation, the engine 14 in a spark-ignition mode is controlled to a stoichiometric air/fuel ratio by the controller 70, the stoichiometric air-to-fuel-ratio (AFR) being the mass ratio of air to fuel present in a combustion process when exactly enough air is provided to completely burn all of the fuel. It is to be understood that any other method of estimating the air mass or the fuel mass ($m_f$) may be employed. The controller 70 may store the predefined fourth constant ($Q_{LHV}$), which is the low-heating value of fuel, in the memory 74. In a non-limiting example, the predefined fourth constant ($Q_{LHV}$) is between 44 and 46 MJ per kilogram.

In block 112 of FIG. 2A, the controller 70 may be programmed to obtain an optimal combustion phasing ($CA_m$) for maximizing a net-mean-effective-pressure (NMEP) of the at least one cylinder 22. The optimal combustion phasing ($CA_m$) is based at least partially on the first and second coefficients (a, b), the volume ($V_{EVO}$) of the at least one cylinder 22 when the at least one exhaust valve 60 is opening, the predefined first constant (γ) and the predefined second constant ($k_1$). The optimal combustion phasing ($CA_m$) can be obtained by finding the solution that maximizes the area (A) of the parallelogram shown in FIG. 3 as follows (where $CA_c$ is combustion phasing):

$$\begin{aligned}&\text{The area of parallelogram}\approx \quad (6)\\&Q_{LHV}m_f(aV_{EVO}^{1-\gamma}CA_c^2-(k_1-bV_{EVO}^{1-\gamma})CA_c-k_2+cV_{EVO}^{1-\gamma})\therefore\\&\frac{\partial}{\partial CA_c}\text{The area of parallelogram}\approx\\&Q_{LHV}m_f(-2aV_{EVO}^{1-\gamma}CA_c+k_1-bV_{EVO}^{1-\gamma})\Rightarrow\\&\frac{\partial}{\partial CA_c}\text{The area of parallelogram}\Big|_{CA_m}=\\&0\therefore CA_m=\frac{k_1-bV_{EVO}^{1-\gamma}}{2aV_{EVO}^{1-\gamma}}\end{aligned}$$

In block 114 of FIG. 2A, the controller 70 may be programmed to determine a desired spark timing ($SP_d$) for controlling the torque output of the engine 14, based at least partially on the desired combustion phasing ($CA_d$), optimal combustion phasing ($CA_m$). Assuming that a predefined nominal spark timing ($SP_{nom}$) is calibrated for maximum torque, and that combustion phasing is proportional to spark timing, the desired spark timing ($SP_d$) (in crank angle before combustion TDC, as indicated by line 41) that achieves the torque demand is obtained as:

$$SP_d=SP_{nom}+h*(CA_d-CA_m) \quad (7)$$

Here, the predefined conversion factor (h) is a positive factor that converts combustion phasing to spark timing. The predefined nominal spark timing ($SP_{nom}$) and predefined conversion factor (h) may be obtained by calibration.

Referring now to FIGS. 3-8 as discussed with respect to block 106 above, example log-scaled pressure-volume (PV) diagrams are shown. In each of FIGS. 3-8, the vertical axis represents the logarithm of pressure in the cylinder 22 (indicated as "$L_P$" in FIG. 3) and the horizontal axis represents logarithm of the volume of the cylinder 22 (indicated as "$L_V$" in FIG. 3).

The area ($A_R$) of the rectangle (R) may be obtained from FIG. 4. The areas ($A_{T1}$, $A_{T2}$) of the first and second triangles (T1,T2) may be obtained from FIGS. 5-6 and 7-8, respectively. The first parameter ($F_1$) represents work done by the cylinder 22. Referring to FIG. 3, the area of the parallelogram (indicated as "A" in FIG. 3) represents indicated work done by the cylinder 22, when the timings of the closing of the intake valve 46 and the opening of the exhaust valve 60 are symmetric around the bottom-dead-center (BDC) (indicated by line 43) of the cylinder 22, assuming a polytropic compression and expansion. Numeral 202 in FIG. 3 indicates the end of combustion (EOC), which is assumed to be the same as the start of combustion (SOC) in this application.

The cylinder 22 defines a plurality of cylinder volumes (indicated as "V" in FIG. 1) varying with the respective closing and opening of the intake valve 46 and exhaust valve 60. The plurality of cylinder volumes (V) include: a first cylinder volume ($V_{EVC}$) when the (last) exhaust valve 60 is closing (moving towards position 62); a second cylinder volume ($V_{EVO}$) when the exhaust valve 60 is opening (moving towards position 64); a third cylinder volume ($V_{IVO}$) when the intake valve 46 is opening (moving towards position 52); and a fourth cylinder volume ($V_{IVC}$) when the (last) intake valve 46 is closing (moving towards position 48). When the engine 14 is equipped with multiple intake valves 46 (or multiple exhaust valves 60), the valve opening timing may be defined as the timing when any of the intake valves are opening and the valve closing timing may be defined as the moment when all the valves are closed. As understood by those skilled in the art, a cylinder clearance volume ($V_c$) is the volume of the cylinder 22 when the top of the piston 30 is at top dead centre (TDC) (indicated by line 41). The cylinder clearance volume is indicated in FIGS. 3-6 as "$C_v$". The maximum cylinder volume is indicated in FIGS. 7-8 as "$M_v$".

The cylinder volumes (V) may be determined by using known slider crank equations, the position of the crankshaft 34 (via crank sensor 80) and respective positions of the first and second camshafts 54, 68 (via first and second position sensors 53, 67, respectively), all shown in FIG. 1. The cylinder pressures (in-cylinder combustion pressure) may be measured using the third pressure sensor 82. The third pressure sensor 82 may be monitored by the controller 70 to determine a net-effective-pressure (NMEP) for each cylinder 22 for each combustion cycle.

As noted above, the area ($A_R$) of the rectangle (R) may be obtained from FIG. 4. When the timing of the closing of the exhaust valve 60 (EVC, indicated by numeral 210 in FIGS. 4-6) is later than or equal to the timing of the opening of the intake valve 46 (IVO, indicated by numeral 212 in FIGS. 4-6)) (i.e., positive valve overlap), the area ($A_R$) of the rectangle (R) in FIG. 4 represents the pumping work. As seen in equation (8) below, the area ($A_R$) of the rectangle (R) is based at least partially on the intake manifold pressure ($p_i$), the exhaust manifold pressure ($p_e$), the cylinder volume ($V_{EVC}$), the cylinder volume ($V_{EVO}$) and the cylinder volume ($V_{IVO}$)

$$\text{The area of square} = \begin{cases} (p_e - p_i)(V_{EVO} - V_{EVC}) & \text{if } IVO < EVC \\ (p_e - p_i)(V_{EVO} - V_{IVO}) & \text{Otherwise} \end{cases} \quad (8)$$

Figure 5:
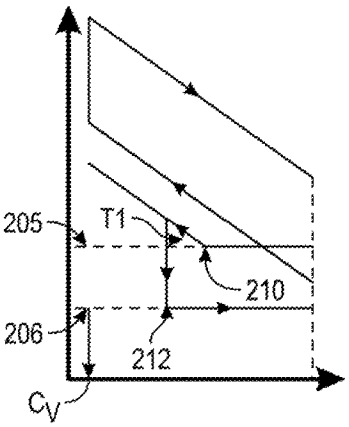
FIG. 5 is an example log-scaled pressure-volume (PV) diagram around TDC (top-dead-center) when the cylinder volume when the intake valve opens is less than the cylinder volume when the exhaust valve closes ($V_{IVO}<V_{EVC}$)
Figure 6:
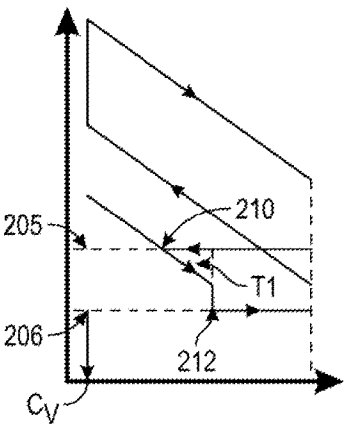
FIG. 6 is an example log-scaled pressure-volume (PV) diagram around TDC (top-dead-center) when the cylinder volume when the intake valve opens is more than the cylinder volume when the exhaust valve closes ($V_{IVO}>V_{EVC}$)
Figure 7:
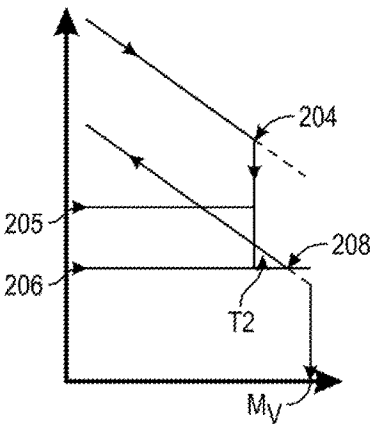
FIG. 7 is an example log-scaled pressure-volume (PV) diagram around BDC (bottom-dead-center) when the cylinder volume when the intake valve closes is more than the cylinder volume when the exhaust valve opens ($V_{IVC}>V_{EVO}$)
Figure 8:
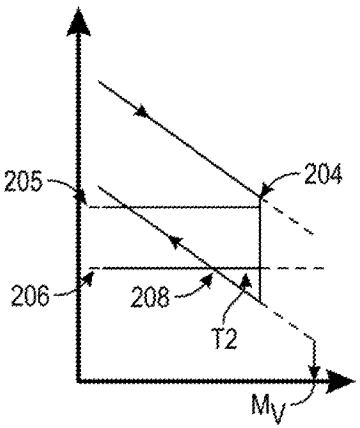
FIG. 8 is an example log-scaled pressure-volume (PV) diagram around BDC (bottom-dead-center) when the cylinder volume when the intake valve closes is less than the cylinder volume when the exhaust valve opens ($V_{IVC}<V_{EVO}$).

Referring to FIGS. 4-7, the logarithm of the exhaust manifold pressure ($p_e$) is indicated by line 205 and the logarithm of the intake manifold pressure ($p_i$), indicated by line 206. As noted above, the area ($A_{T1}$) of the first triangle (T1) may be obtained from FIGS. 5-6. The area ($A_{T1}$) of the first triangle (T1) represents pumping work when the closing of the exhaust valve 60 (referred to herein as "EVC") is earlier than the timing of the opening of the intake valve 46 (referred to herein as "IVO") (i.e., negative valve overlap), and ($V_{IVO}>V_{EVC}$) or vice versa. In FIG. 5, the cylinder volume at IVO is less than the cylinder volume at EVC ($V_{IVO}<V_{EVC}$), with negative valve overlap (when EVC is earlier than IVO). In FIG. 6, the cylinder volume at IVO is more than the cylinder volume at EVC ($V_{IVO}>V_{EVC}$); with negative valve overlap (when EVC is earlier than IVO). The area ($A_{T1}$) of the first triangle (T1) may be expressed as follows:

$$\text{The area of triangle 1} = \int_{V_{EVC}}^{V_{IVO}} \left(p_e - p_e\left(\frac{V_{EVC}}{V}\right)^{\gamma}\right) dV = p_e(V_{IVO} - V_{EVC}) - \frac{p_e V_{EVC}^{\gamma}}{1-\gamma}\left(V_{IVO}^{1-\gamma} - V_{EVC}^{1-\gamma}\right) \quad (9)$$

Referring to FIGS. 7-8, example log-scaled PV diagrams are shown when the timing of the closing of the intake valve 46 (referred to herein as "IVC", 208) and the timing of the opening of the exhaust valve 60 (referred to herein as "EVO", 204) are asymmetric around the BDC. The area ($A_{T2}$) of the second triangle (T2) may be obtained from FIGS. 7-8. The area of the second triangle (T2) may be expressed as follows:

$$\text{The area of triangle 2} = \int_{V_{EVO}}^{V_{IVC}} \left(p_i\left(\frac{V_{IVC}}{V}\right)^{\gamma} - p_i\right) dV = \frac{p_i V_{IVC}^{\gamma}}{1-\gamma}\left(V_{IVC}^{1-\gamma} - V_{EVO}^{1-\gamma}\right) - p_i(V_{IVC} - V_{EVO}) \quad (10)$$

As seen in equation (9) above, the area ($A_{T1}$) of the first triangle (T1) is based at least partially on the intake manifold pressure ($p_i$), the exhaust manifold pressure ($p_e$), the cylinder volume ($V_{EVC}$) and the cylinder volume ($V_{IVO}$). As seen in equation (4) above, the area ($A_{T2}$) of the second triangle (T2) is based at least partially on the intake manifold pressure ($p_i$), the exhaust manifold pressure ($p_e$), the cylinder volume ($V_{EVO}$) and the cylinder volume ($V_{IVC}$).

In summary, the desired combustion phasing ($CA_d$) is tailored to produce an engine torque corresponding to the torque request ($T_R$). The method 100 (and the controller 70 executing the method 100) improves the functioning of the vehicle by enabling control of torque output of a complex engine system with a minimum amount of calibration required. Thus the method 100 (and the controller 70 executing the method 100) are not mere abstract ideas, but are intrinsically tied to the functioning of the vehicle 10 and the (physical) output of the engine 14. The method 100 may be executed continuously during engine operation as an open-loop operation.

The method 100 assumes instantaneous combustion in a constant-volume model such that cylinder pressure instantaneously equilibrates with external pressure (such as intake or exhaust manifold pressure) once the intake valve 46 or exhaust valve 60 opens. As a result, the log-scaled PV diagrams consist of geometrical shapes with sharp edges as shown in FIGS. 3-8. To closely approximate the PV diagram of a real engine with the ideal PV diagram of the method 100, the valve timings may be adjusted (as shown in the set of equations (11) below) with parameters $D_{IVC}$, $D_{IVO}$, $D_{EVC}$ and $D_{EVO}$, which are positive numbers describing the difference between the actual and the effective closing and opening timings of the intake and exhaust valves 46, 60 in crank angle (CA), and can be calibrated as functions of engine speed or other variables. Here IVC, IVO, EVC and EVO are the actual closing and opening timings of the intake and exhaust valves 46, 60, respectively, $IVC_{EFF}$, $IVO_{EFF}$, $EVC_{EFF}$, and $EVO_{EFF}$ are the effective closing and opening timings of the intake and exhaust valves 46, 60, respectively.

$$IVC_{EFF}=IVC-D_{IVC}$$

$$IVO_{EFF}=IVO+D_{IVO}$$

$$EVC_{EFF}=EVC-D_{EVC}$$

$$EVO_{EFF}=EVO+D_{EVO} \quad (11)$$

The controller 70 of FIG. 1 may be an integral portion of, or a separate module operatively connected to, other controllers of the vehicle 10, such as the engine controller. The vehicle 10 may be any passenger or commercial automobile such as a hybrid electric vehicle, including a plug-in hybrid electric vehicle, an extended range electric vehicle, or other vehicles. The vehicle 10 may take many different forms and include multiple and/or alternate components and facilities.

The controller 70 includes a computer-readable medium (also referred to as a processor-readable medium), including any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which may constitute a main memory. Such instructions may be transmitted by one or more transmission media, including coaxial cables, copper wire and fiber optics, including the wires that comprise a system bus coupled to a processor of a computer. Some forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Look-up tables, databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store may be included within a computing device employing a computer operating system such as one of those mentioned above, and may be accessed via a network in any one or more of a variety of manners. A file system may be accessible from a computer operating system, and may include files stored in various formats. An RDBMS may employ the Structured Query Language (SQL) in addition to a language for creating, storing, editing, and executing stored procedures, such as the PL/SQL language mentioned above.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. An engine assembly comprising:

an internal combustion engine including an engine block having at least one cylinder defining a bore axis, and at least one piston moveable within the at least one cylinder;

wherein the internal combustion engine includes a crankshaft defining a crank axis, the crankshaft being moveable to define a plurality of crank angles (CA) from the bore axis to the crank axis;

at least one intake valve and at least one exhaust valve, each in fluid communication with the at least one cylinder and each having respective open and closed positions;

a spark plug operatively connected to the at least one cylinder;

a controller operatively connected to the internal combustion engine and configured to receive a torque request ($T_R$);

wherein the controller includes a processor and tangible, non-transitory memory on which is recorded instructions, execution of the instructions by the processor causing the controller to:

obtain a first parameter ($Z_1$) for each of a plurality of crank angles (CA) based at least partially on a respective cylinder volume ($V_{CA}$) of the at least one cylinder, a predefined first constant ($\gamma$), a predefined second constant ($k_1$) and a predefined third constant ($k_2$), such that $Z_1=[(k_1*CA+k_2)*(V_{CA})^{\gamma-1}]$;

obtain a first, a second and a third coefficient (a, b, c), the first parameter ($Z_1$) being approximated with a quadratic function of the plurality of crank angles (CA) with the first, second and third coefficients (a, b, c) such that $Z_1=[a*CA^2+b*CA+c]$;

determine a desired combustion phasing ($CA_d$) based at least partially on the torque request ($T_R$) and the first, second and third coefficients (a, b, c);

obtain a desired spark timing ($SP_d$) based at least partially on the desired combustion phasing ($CA_d$); and control the spark plug based at least partially on the desired spark timing ($SP_d$) in order to control the torque of the internal combustion engine.

2. The engine assembly of claim 1, wherein the desired combustion phasing ($CA_d$) is characterized by one of the plurality of crank angles (CA) corresponding to 50% of fuel being combusted and the at least one piston being after a top-dead-center (TDC) position.

3. The engine assembly of claim 1, wherein said determining the desired combustion phasing ($CA_d$) includes:

obtaining a second parameter ($Z_2$) as a sum of respective geometrical areas of a plurality of geometrical shapes in a log-scaled pressure-volume (PV) diagram of the at least one cylinder.

4. The engine assembly of claim 1, wherein said determining the desired combustion phasing ($CA_d$) includes:

obtaining a second parameter ($Z_2$) as $Z_2=(A_R+A_{T1}+A_{T2})$;

wherein $A_R$ is an area of a rectangle in the log-scaled pressure-volume (PV) diagram; and wherein $A_{T1}$ and $A_{T2}$ are respective areas of a first and a second triangle in the log-scaled pressure-volume (PV) diagram.

5. The engine assembly of claim 3, wherein said determining the desired combustion phasing ($CA_d$) includes:

obtaining a third parameter ($Z_3$) as a sum of the second parameter ($Z_2$) and a product of the torque request ($T_R$) and pi ($\pi$) such that $[Z_3=Z_2+(T_R*\pi)]$.

6. The engine assembly of claim 5, wherein said determining the desired combustion phasing ($CA_d$) includes:

obtaining the desired combustion phasing ($CA_d$) based at least partially on the third parameter ($Z_3$), a fuel mass ($m_f$), the first, second and third coefficients (a, b, c), a volume ($V_{EVO}$) of the at least one cylinder when the at least one exhaust valve is opening, the predefined first constant ($\gamma$), the predefined second constant ($k_1$), the predefined third constant ($k_2$) and a predefined fourth constant ($Q_{LHV}$).

7. The engine assembly of claim 5, wherein the controller is programmed to determine an optimal combustion phasing ($CA_m$) for maximizing a net-mean-effective-pressure of the at least one cylinder, the optimal combustion phasing ($CA_m$) being based at least partially on the first and second coefficients (a, b), the volume ($V_{EVO}$) of the at least one cylinder when the at least one exhaust valve is opening, the predefined first constant ($\gamma$) and the predefined second constant ($k_1$).

8. The engine assembly of claim 7, wherein the optimal combustion phasing ($CA_m$) is defined as:

$$CAm = \frac{k_1 - bV_{EVO}^{1-\gamma}}{2aV_{EVO}^{1-\gamma}}.$$

9. The engine assembly of claim 7, wherein the controller is programmed to determine the desired spark timing ($SP_d$) for controlling the torque output of the internal combustion engine based at least partially on the desired combustion phasing ($CA_d$), the maximized combustion phasing ($CA_m$), a predefined nominal spark timing ($SP_{nom}$) and a predefined conversion factor (h) such that:

$$SP_d=SP_{nom}+h*(CA_d-CA_m).$$

10. A method for controlling torque in an engine assembly with a desired combustion phasing ($CA_d$), the engine assembly including an internal combustion engine having an engine block with at least one cylinder, at least one piston moveable within the at least one cylinder; at least one intake valve and at least one exhaust valve each in fluid communication with the at least one cylinder and having respective open and closed positions, a spark plug operatively connected to the at least one cylinder and a controller configured to receive a torque request ($T_R$), the method comprising:

obtaining a first parameter ($Z_1$), via the controller, for each of a plurality of crank angles (CA) based at least partially on a respective cylinder volume ($V_{CA}$) of the at least one cylinder, a predefined first constant ($\gamma$), a predefined second constant ($k_1$) and a predefined third constant ($k_2$), such that $Z_1=[(k_1*CA+k_2)*(V_{CA})^{\gamma-1}]$;

obtaining a first, a second and a third coefficient (a, b, c), via the controller, the first parameter ($Z_1$) being approximated with a quadratic function of the plurality of crank angles (CA) with the first, second and third coefficients (a, b, c) such that $Z_1=[a*CA^2+b*CA+c]$;

obtaining the desired combustion phasing ($CA_d$) based at least partially on the torque request ($T_R$) and the first, second and third coefficients (a, b, c), obtaining a desired spark timing ($SP_d$) based at least partially on the desired combustion phasing ($CA_d$); and controlling the spark plug based at least partially on the desired spark timing ($SP_d$) in order to control the torque of the internal combustion engine.

11. The method of claim 10, further comprising:

obtaining a second parameter ($Z_2$), via the controller, as a sum of respective geometrical areas of a plurality of geometrical shapes in the log-scaled pressure-volume (PV) diagram such that ($Z_2=A_R+A_{T1}=A_{T2}$);

wherein $A_R$ is an area of a rectangle in a log-scaled pressure versus volume diagram of the at least one cylinder; and wherein $A_{T1}$ and $A_{T2}$ are respective areas of a first and a second triangle in the log-scaled pressure versus volume diagram.

12. The method of claim 11, further comprising:

obtaining a third parameter ($Z_3$), via the controller, as a sum of the second parameter ($Z_2$) and a product of the torque request ($T_R$) and pi ($\pi$) such that $[Z_3=Z_2+(T_R*\pi)]$.

13. The method of claim 12, further comprising:

obtaining the desired combustion phasing ($CA_d$), via the controller, based at least partially on the third parameter ($Z_3$), a fuel mass ($m_f$), the first, second and third coefficients (a, b, c), a volume ($V_{EVO}$) of the at least one cylinder when the at least one exhaust valve is opening, the predefined first constant ($\gamma$), the predefined second constant ($k_1$), the predefined third constant ($k_2$) and a predefined fourth constant ($Q_{LHV}$).

14. The method of claim 12, further comprising:

obtaining an optimal combustion phasing ($CA_m$), via the controller, for maximizing a net-mean-effective-pressure of the at least one cylinder, the optimal combustion phasing ($CA_m$) being based at least partially on the first and second coefficients (a, b), the volume ($V_{EVO}$) of the at least one cylinder when the at least one exhaust valve is opening, the predefined first constant ($\gamma$) and the predefined second constant ($k_1$).

15. The method of claim 14, wherein the optimal combustion phasing ($CA_m$) is defined as:

$$CAm = \frac{k_1 - bV_{EVO}^{1-\gamma}}{2aV_{EVO}^{1-\gamma}}.$$

16. The method of claim 14, further comprising:

determining the desired spark timing ($SP_d$) for controlling the torque output of the internal combustion engine, via the controller, based at least partially on the desired combustion phasing ($CA_d$), the optimal combustion phasing ($CA_m$), a predefined nominal spark timing ($SP_{nom}$) and a predefined conversion factor (h) such that:

$$SP_d=SP_{nom}+h*(CA_d-CA_m).$$

* * * * *